US006435991B1

(12) United States Patent
Kishek

(10) Patent No.: US 6,435,991 B1
(45) Date of Patent: Aug. 20, 2002

(54) TENNIS RACKET WITH CROSS-BAR HANDLE

(76) Inventor: James Kishek, 23 Aguilar, Irvine, CA (US) 92614

( * ) Notice: Subject to any disclaimer, the term of this patent is extended or adjusted under 35 U.S.C. 154(b) by 0 days.

(21) Appl. No.: 09/872,021

(22) Filed: Jun. 1, 2001

(51) Int. Cl.[7] ..... A63B 49/08
(52) U.S. Cl. ..... 473/551; 473/526; 473/549
(58) Field of Search ..... 473/518, 524, 473/549, 551, 552, 526, 527

(56) References Cited

U.S. PATENT DOCUMENTS 4,676,505 A * 6/1987 Rodriguez et al. ..... 473/526
4,721,305 A * 1/1988 Cudlip ..... 473/526
4,861,030 A * 8/1989 Burt ..... 473/526
5,183,260 A * 2/1993 Kheir ..... 473/526
5,366,218 A * 11/1994 Gong ..... 473/551

FOREIGN PATENT DOCUMENTS

DE 3404831 * 8/1985 ..... 473/FOR 183
DE 3627953 * 3/1988 ..... 473/FOR 183

* cited by examiner

*Primary Examiner*—Raleigh W. Chiu
(74) *Attorney, Agent, or Firm*—Goldstein & Lavas, P.C.

(57) ABSTRACT

A tennis racket with a crossbar handle including a racket head defining a striking surface. A handle member extends downwardly from the racket head. The handle member has a generally U-shaped configuration.

5 Claims, 2 Drawing Sheets

TENNIS RACKET WITH CROSS-BAR HANDLE

BACKGROUND OF THE INVENTION

The present invention relates to a tennis racket with a crossbar handle and more particularly pertains to improving a tennis player's ability to effectively strike a tennis ball during play.

The use of sports racket grip devices is known in the prior art. More specifically, sports racket grip devices heretofore devised and utilized for the purpose of improving the grip of sports rackets are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,762,572 to Chuang discloses a tennis racket with a first handle and an auxiliary handle for use with holding the racket with two handles. U.S. Pat. No. 3,868,110 to Jones and U.S. Pat. No. 4,664,381 to Aaron disclose additional tennis racket grip devices.

While these devices fulfill their respective, particular objective and requirements, the aforementioned patents do not describe a tennis racket with a crossbar handle for improving a tennis player's ability to effectively strike a tennis ball during play.

In this respect, the tennis racket with crossbar handle according to the present invention substantially departs from the conventional concepts and designs of the prior art, and in doing so provides an apparatus primarily developed for the purpose of improving a tennis player's ability to effectively strike a tennis ball during play.

Therefore, it can be appreciated that there exists a continuing need for a new and improved tennis racket with a crossbar handle which can be used for improving a tennis player's ability to effectively strike a tennis ball during play. In this regard, the present invention substantially fulfills this need.

SUMMARY OF THE INVENTION

In the view of the foregoing disadvantages inherent in the known types of sports racket grip devices now present in the prior art, the present invention provides an improved tennis racket with a crossbar handle. As such, the general purpose of the present invention, which will be described subsequently in greater detail, is to provide a new and improved tennis racket with a crossbar handle which has all the advantages of the prior art and none of the disadvantages.

To attain this, the present invention essentially comprises a racket head defining a striking surface. A handle member extends downwardly from the racket head. The handle member has a generally U-shaped configuration. The handle member includes a pair of vertical segments depending from the racket head. The pair of vertical segments each have free lower ends. The handle member includes a horizontal segment extending between the pair of vertical segments upwardly of the free lower ends thereof. A pair of arcuate arm supports extend downwardly from the handle member for receiving an arm of a user therebetween. The pair of arm supports each have an upper end and a lower end. The upper ends are pivotally coupled with the free lower ends of the pair of vertical segments of the handle member. The arm supports each have a padded interior. The arm supports have corresponding male and female locking clips for engaging each other when the arm of the user is positioned therebetween.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tennis racket with a crossbar handle which has all the advantages of the prior art sports racket grip devices and none of the disadvantages.

It is another object of the present invention to provide a new and improved tennis racket with a crossbar handle which may be easily and efficiently manufactured and marketed.

It is a further object of the present invention to provide a new and improved tennis racket with a crossbar handle which is of durable and reliable construction.

An even further object of the present invention is to provide a new and improved tennis racket with a crossbar handle which is susceptible of a low cost of manufacture with regard to both materials and labor, and which accordingly is then susceptible of low prices of sale to the consuming public, thereby making such a tennis racket with a crossbar handle economically available to the buying public.

Even still another object of the present invention is to provide a new and improved tennis racket with a crossbar handle for improving a tennis player's ability to effectively strike a tennis ball during play.

Lastly, it is an object of the present invention to provide a new and improved tennis racket with crossbar handle including a racket head defining a striking surface. A handle member extends downwardly from the racket head. The handle member has a generally U-shaped configuration.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 2:
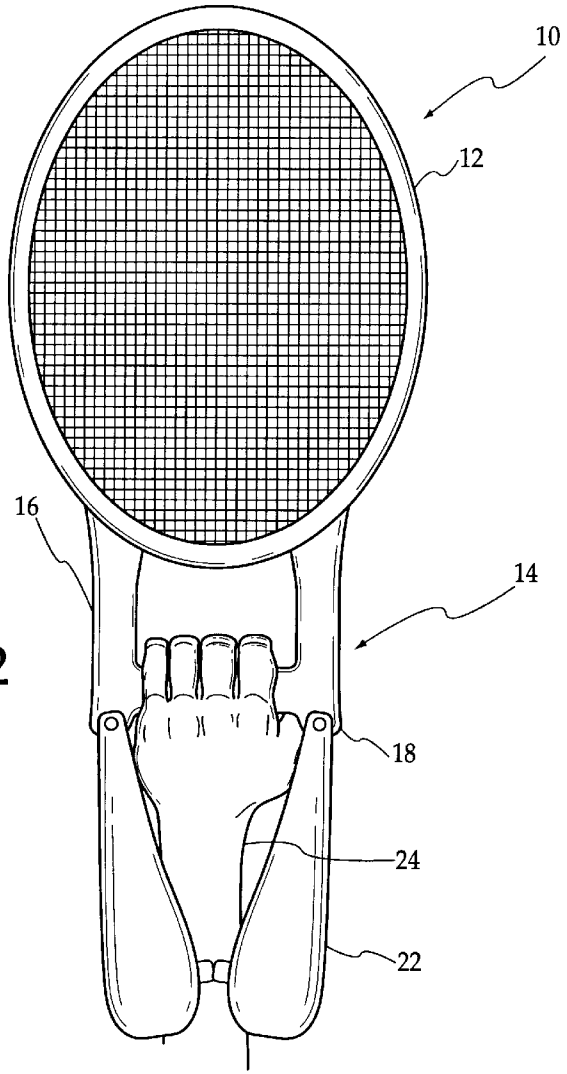
FIG. 2 is a plan view of the present invention illustrated in use.
Figure 1:
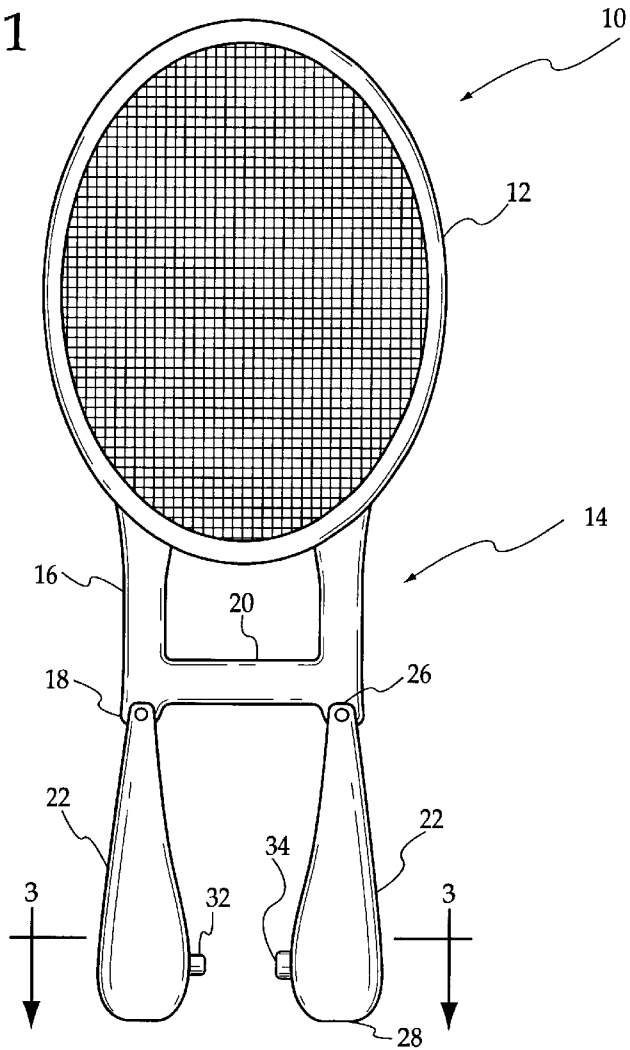
FIG. 1 is a plan view of the preferred embodiment of the tennis racket with a crossbar handle constructed in accordance with the principles of the present invention.
Figure 3:
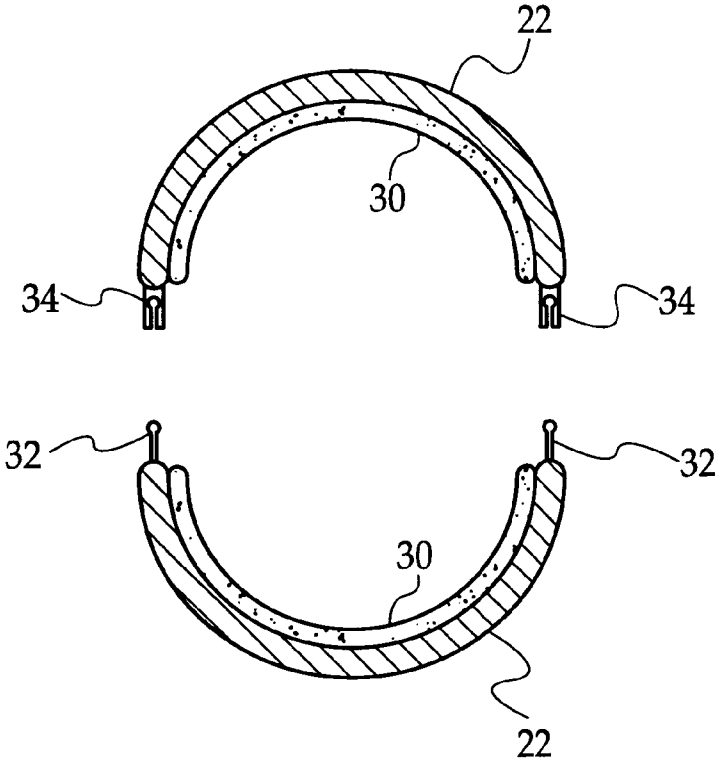
FIG. 3 is a cross-sectional view of the present invention as taken along line 3—3 of FIG. 1.

With reference now to the drawings, and in particular, to FIGS. 1 through 3 thereof, the preferred embodiment of the new and improved tennis racket with a crossbar handle embodying the principles and concepts of the present invention and generally designated by the reference number 10 will be described.

Specifically, it will be noted in the various figures that the device relates to a tennis racket with a crossbar handle for improving a tennis player's ability to effectively strike a tennis ball during play. In its broadest context, the device consists of a racket head, a handle member, and a pair of arcuate arm supports. Such components are individually configured and correlated with respect to each other so as to attain the desired objective.

The racket head 12 defines a striking surface. The racket head 12 is similar in design to standard tennis rackets with a generally ovoid shape with intersecting strings disposed within the racket head 12.

The handle member 14 extends downwardly from the racket head 12. The handle member 14 has a generally U-shaped configuration. The handle member 14 includes a pair of vertical segments 16 depending from the racket head 12. The pair of vertical segments 16 each have free lower ends 18. The handle member 14 includes a horizontal segment 20 extending between the pair of vertical segments 16 upwardly of the free lower ends 18 thereof. The horizontal segment 20 provides a grip for the person wielding the present invention departing from the standard vertical handle normally associated with tennis rackets.

The pair of arcuate arm supports 22 extend downwardly from the handle member 12 for receiving an arm 24 of a user therebetween while the user's hand grips the horizontal segment 20. The pair of arm supports 22 each have an upper end 26 and a lower end 28. The upper ends 26 are pivotally coupled with the free lower ends 18 of the pair of vertical segments 16 of the handle member 14. The arm supports 22 each have a padded interior 30. The arm supports 22 have corresponding male and female locking clips 32,34 for engaging each other when the arm 24 of the user is positioned therebetween. The clips 32,34 will lock the arm supports 22 around the user's arm 24. The pivotal coupling of the upper ends 26 to the free lower ends 18 allow the user to adjust the arm supports 22 to comfortably position their arm between the arm supports 22.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompasses by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tennis racket with a crossbar handle for improving a tennis player's ability to effectively strike a tennis ball during play comprising, in combination:

a racket head defining a striking surface;

a handle member extending downwardly from the racket head, the handle member having a generally U-shaped configuration, the handle member including a pair of vertical segments depending from the racket head, the pair of vertical segments each having free lower ends, the handle member including a horizontal segment extending between the pair of vertical segments upwardly of the free lower ends thereof; and a pair of arcuate arm supports extending downwardly from the handle member for receiving an arm of a user therebetween, the pair of arm supports each having an upper end and a lower end, the upper ends being pivotally coupled with the free lower ends of the pair of vertical segments of the handle member, the arm supports each having a padded interior, the arm supports having corresponding male and female locking clips for engaging each other when the arm of the user is positioned therebetween.

2. A tennis racket with a crossbar handle for improving a tennis player's ability to effectively-strike a tennis ball during play comprising, in combination:

a racket head defining a striking surface;

a handle member extending downwardly from the racket head, the handle member having a generally U-shaped configuration; and a pair of arcuate arm supports extending downwardly from the handle member for receiving an arm of a user therebetween.

3. The tennis racket with a crossbar handle as set forth in claim 2, wherein the pair of arm supports each having an upper end and a lower end, the upper ends being pivotally coupled with the handle member.

4. The tennis racket with a crossbar handle as set forth in claim 3, wherein the arm supports each have a padded interior.

5. The tennis racket with a crossbar handle as set forth in claim 2, wherein the arm supports having corresponding male and female locking clips for engaging each other when the arm of the user is positioned therebetween.

* * * * *